US005963115A

United States Patent [19]

Holleboom et al.

[11] Patent Number: 5,963,115

[45] **Date of Patent: *Oct. 5, 1999**

[54] CERAMIC FILTER HAVING REDUCED INSERTION LOSSES

[75] Inventors: Antonius G. Holleboom; Johannes Brandsma; Hermanus G. M. Titulaer, all of Roermond, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/870,881

[22] Filed: Jun. 9, 1997

[30] Foreign Application Priority Data

Jun. 12, 1996 [EP] European Pat. Off. ..... 96201640

[51] Int. Cl.[6] ..... H01P 1/203

[52] U.S. Cl. ..... 333/204; 333/219

[58] Field of Search ..... 333/204, 205, 333/219

[56] References Cited

U.S. PATENT DOCUMENTS

| | | | |
|---|---|---|---|
| 4,612,689 | 9/1986 | de Wild et al. | 29/25.42 |
| 5,160,905 | 11/1992 | Hoang | 333/204 |
| 5,288,351 | 2/1994 | Hoang et al. | 333/204 X |
| 5,349,314 | 9/1994 | Shimizu et al. | 333/204 |
| 5,489,881 | 2/1996 | Yuda et al. | 333/204 X |
| 5,497,130 | 3/1996 | Hirai et al. | 333/204 |
| 5,621,366 | 4/1997 | Gu et al. | 333/204 |
| 5,691,676 | 11/1997 | Snel et al. | 333/204 |

FOREIGN PATENT DOCUMENTS

| | | |
|---|---|---|
| 0127527 | 12/1984 | European Pat. Off. . |
| 0541397A1 | 5/1993 | European Pat. Off. . |
| 0641035 | 3/1995 | European Pat. Off. . |
| 1218089 | 8/1989 | Japan . |
| 6164223 | 6/1994 | Japan . |

*Primary Examiner*—Seungsook Ham

[57] ABSTRACT

The Application describes a ceramic filter as well as a method of manufacturing same. Such filters comprise at least two stripline resonators in the form of printed metal layers which, during operation of the filter, are electromagnetically coupled and which are separated from each other by means of a ceramic dielectric. In accordance with the invention, the metal layers (preferably of palladium) must have a minimum thickness of 10 micrometers, and they are substantially rectangular in cross-section. Filters having these characteristics exhibit surprisingly low insertion losses during operation. The invention can very advantageously be used in so-called broadline-coupling filters.

3 Claims, 5 Drawing Sheets

CERAMIC FILTER HAVING REDUCED INSERTION LOSSES

BACKGROUND OF THE INVENTION

The invention relates to a ceramic filter comprising at least two stripline resonators in the form of printed metal layers which, during operation of the filter, are electromagnetically coupled and which are separated by means of a ceramic dielectric. The invention also relates to a method of manufacturing such a ceramic filter.

Ceramic filters are used, in particular, in transmitters and receivers for high-frequency signals, such as receivers for GSM, PCN and DECT systems. These systems utilize high-frequency signals in the MHz range. For example, GSM (Global System for Mobile Communication) operates in the 900 MHz band, PCN (Personal Communication Network) utilizes a frequency of 1800 MHz and DECT (Digital European Cordless System) also utilizes a frequency of approximately 1800 MHz. Said filters are used, in particular, to suppress undesired signals whose frequency is outside the frequency range used. This is necessary to preclude overloading of the receiver by strong transmitters outside this frequency range.

A ceramic filter of the type mentioned in the opening paragraph as well as a method of manufacturing said filter are known per se. A description thereof is given, for example, in European Patent Application EP-A 541.397. Said Patent Application describes, more particularly, a laminated filter which comprises two stripline resonators of silver or copper and which are provided on a ceramic foil by means of a printing technique, i.e. screen printing. During operation of the known filter, electromagnetic coupling takes place in the plane of the resonators (x,y coupling).

In practice, it has been found that the insertion losses of the known filter are relatively high. This leads to an undesirable reduction in sensitivity of receivers in which said known filter is used.

SUMMARY OF THE INVENTION

It is an object of the invention to provide a ceramic filter in which the insertion losses during operation of the filter are considerably reduced.

These and other objects of the invention are achieved by a ceramic filter comprising at least two stripline resonators in the form of printed metal layers which, during operation of the filter, are electromagnetically coupled and which are separated by means of a ceramic dielectric, which filter is characterized according to the invention in that the metal layers have a thickness of at least 10 micrometers and a substantially rectangular cross-section.

The invention is based on the experimentally gained insight that the insertion losses of the known filter are governed to a substantial degree by the shape and the thickness of the stripline resonators. It has been found that the insertion losses can be reduced substantially if the resonators have a thickness of at least 10 micrometers. During operation of the filter, the electric resistance of the printed metal layers will cause considerable resistance losses at high frequencies if the resonators have a thickness below at least 10 micrometers. These resistance losses contribute substantially to the insertion losses of the filter. The thickness of the stripline resonators is preferably above 15 micrometers. In this case, the electric resistance of the layers contributes to only a small extent to the losses of the filter. The best results are achieved with stripline resonators whose thickness ranges between 20 and 30 micrometers. In practice, it has been found to be difficult to print metal layers having a thickness in excess of 30 micrometers.

In addition, it has been experimentally established that the shape of the stripline resonators also has a great influence on the magnitude of the insertion losses. This type of ceramic filter is customarily manufactured in such a manner that the side faces of the printed stripline resonators, viewed in cross-section, are punctiform. As a result thereof, a high current density at the side faces of the stripline resonators develops during operation of the filter. This leads to an increase of the insertion losses. If, however, the filter comprises substantially rectangular stripline resonators, then a substantial reduction of said insertion losses is achieved. It is noted, that the expression "substantially rectangular" is to be understood to mean in this context that the thickness of the metal layer, as measured at each of the side faces thereof, is at least 60%, and preferably at least 80%, of the average thickness of the metal layer between said side faces.

A favorable embodiment of the two ceramic filter in accordance with the invention is characterized in that the metal layers extend in at least two, substantially parallel, non-coinciding planes, and said metal layers, viewed from a direction normal to the layers, overlap at least partly.

Coupling between the resonators in ceramic filters of this construction takes place mainly at the center of the stripline resonators (z-coupling). Filters of this type are described in the Euro-PCT Patent Application EP 745 277-A1. As described in EP 541 397, imperfections in the side faces of the resonators have a smaller negative effect in z-coupling filters than in x,y-coupled filters. In the case of z-coupling filters, the use of substantially rectangular, relatively thick resonators leads to a further reduction of the insertion losses.

A further favorable embodiment of the ceramic filter in accordance with the invention is characterized in that the metal layers comprise predominantly palladium. It has been found that stripline resonators in the form of printed metal layers which consist predominantly of palladium can be manufactured in a simple manner. Besides, palladium has a relatively high melting point, so that the use of stripline resonators of this material does not impose restrictions on the choice of the sintering temperature of the ceramic dielectric. In addition, it has been found that the surface roughness of printed metal layers contributes to the insertion losses. In the case of an equal degree of surface roughness, palladium layers contribute less to these losses than layers which are made, for example, of copper or silver. It is noted that a small portion (maximally 40 wt. %) of the palladium can be replaced by another metal.

The invention also relates to a method of manufacturing a ceramic filter which comprises at least two stripline resonators in the form of printed metal layers which, during operation of the filter, are electromagnetically coupled and which are separated by means of a ceramic dielectric, which method comprises the following steps:

a) printing metal layers in accordance with a pattern onto a ceramic foil by means of a paste, b) stacking one or more printed foils and a number of unprinted foils to form a filter, c) calcining and sintering said filter.

The method in accordance with the invention is characterized in that the solids content of the paste used for the metal layers amounts to at least 80% and in that for stacking the foils, a thin layer of a ceramic paste is provided on the printed foil(s).

It has been found that the use of these measures leads to resonators which, viewed in cross-section, are substantially rectangular. It is assumed that the use of the above-mentioned paste for the metal layers strongly suppresses the spread of the printed layers when the filter is subjected to further processes. The solids content of this paste is preferably above 85%. It is assumed that the ceramic paste used for stacking causes the voids next to the metal layers to be filled up. The solids content of this paste is, for example, approximately 60%. In the latter paste, use is preferably made of the same ceramic material as in the foils. It has been found that both measures are necessary to manufacture printed metal layers whose shape, viewed in section, is substantially rectangular.

In principle, to provide the stripline resonators use can be made of different types of pastes, such as pastes whose metal content consists predominantly of silver or copper. It has been found that pastes whose metal content consists predominantly of palladium yield good results in ceramic filters in accordance with the invention. As mentioned hereinabove, the use of palladium has advantages for the manufacture of the filters (high sintering temperature) and for the use of these filters (lower insertion losses).

These and other aspects of the invention will be apparent from and elucidated with reference to the embodiments described hereinafter.

It is noted that, for clarity, the Figures are not drawn to scale.

DETAILED DESCRIPTION

Figure 1:
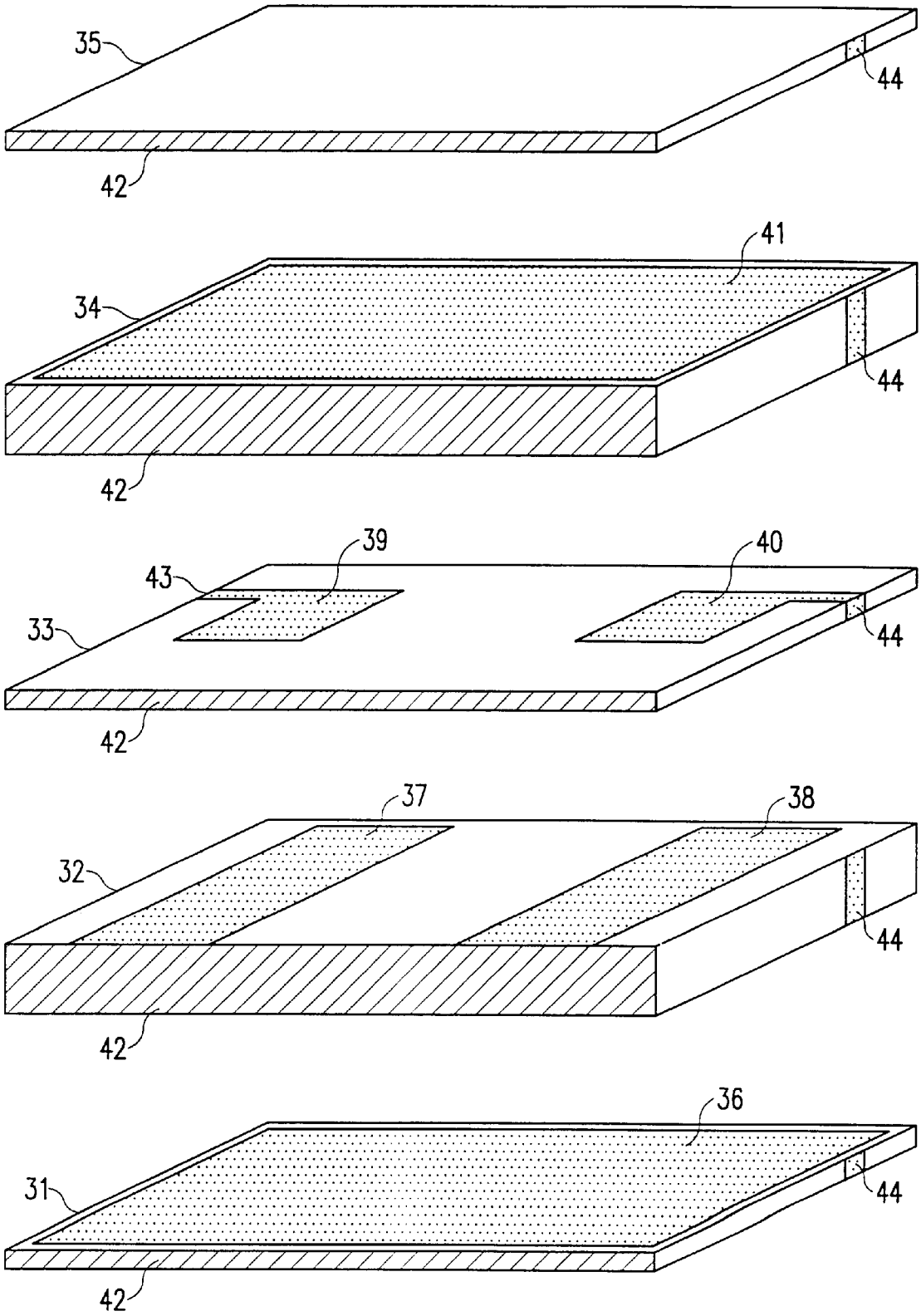
FIG. 1 is a schematic, perspective view of a ceramic filter with x,y-coupling.

FIG. 1 schematically shows the structure of a ceramic filter with x,y-coupling in which use is made of the present invention. The filter comprises five ceramic layers consisting of a barium-neodymium-titanate having a dielectric constant of approximately 70. For clarity, the layers are drawn so as to be apart from each other. The filter comprises a bottom layer 31 on which a first base plate 36 of printed palladium is provided. Said bottom layer supports a first intermediate layer 32 on which two printed stripline resonators 37, 38 of palladium are provided. Said resonators have a thickness of at least 10 micrometers, preferably at least 15 micrometers. In the present case, the thickness is approximately 22 micrometers. The printed stripline resonators are predominantly rectangular in cross-section.

The first ceramic intermediate layer 32 is provided with a second intermediate layer 33. Two palladium capacitor plates 39, 40 are printed on said second intermediate layer. A third intermediate layer 34, which is provided with a second base plate 41 of printed palladium, is applied to intermediate layer 33. An unprinted ceramic top layer 35 is present on intermediate layer 34. Dependent upon the desired thickness of each of the ceramic layers, these layers may be composed of 10 or more ceramic sub-layers. It is noted that, in the description of the preferred embodiment, the layers provided are made of palladium. However, the effect intended in accordance with the invention can also be achieved if the filter described herein is alternatively provided with printed layers of silver or copper.

The filter further comprises an earth electrode 42, which entirely covers a side face of the filter and electrically contacts the stripline resonators 37 and 38. Said filter is also provided with an input contact 43 and an output contact 44, which electrically contact capacitor plates 39 and 40, respectively.

The invention is preferably used in a ceramic filter with z-coupling. In filters of this construction the lowest losses can be attained. Such a filter is described by means of FIG. 2. The filter shown in said Figure comprises a first base plate 1 and a second base plate 2 between which a first stripline resonator 3 and a second stripline resonator 4 in the form of printed metal layers are provided. In accordance with an essential aspect of the invention, the thickness of these metal layers should be at least 10 micrometers, preferably at least 15 micrometers. In the present case, the thickness was approximately 24 micrometers. In accordance with another essential aspect of the invention, the cross-section of the metal layers is substantially rectangular. In this case, the thickness of the metal layer, measured at the side faces of the layer, was at least 80% of the average thickness thereof. Palladium was used as the material for the resonators.

The first stripline resonator 3 and the second stripline resonator 4 are connected, at an end, to an end of both the first base plate 1 and the second base plate 2 by means of a conductive side face 5. The other end of the stripline resonator 3 is capacitively coupled to a conductive side face 6 by means of capacitor plates 7 and 8. The other end of the stripline resonator 4 is capacitively coupled to the conductive side face 6 by means of capacitor plates 9 and 10. The conductive side face 6 is also connected to the first base plate 1 and to the second base plate 2.

The stripline resonators have a length of $\lambda/8$. The capacitors are there to enable the stripline resonators 3 and 4 having a length of $\lambda/8$ to resonate. During operation of the filter, the stripline resonators 3 and 4 are magnetically coupled via a coupling opening in a further conductor 11. Said conductor 11 is provided between the stripline resonators 3 and 4. The size of the coupling opening determines the degree of coupling between the first stripline resonator 3 and the second stripline resonator 4. The input signal of the filter is supplied to an input contact 12 which is situated at a side face of the filter. This contact is connected to the first stripline resonator 3 via an electroplated tap 13. The output signal of the filter is made available to an output contact 14 which is situated at the opposite side face of the filter. This contact 14 is connected to the second stripline resonator 4 via an electroplated tap 15.

The conductors 16 and 17 are provided at the side face of the filter to enable said filter to be adjusted. The conductors 16 and 17 are connected to the side face 6, to the first base plate 1 and to the second base plate 2. The filter is adjusted by reducing the length of the conductor 16 and/or the conductor 17. This can be achieved by removing material from the end portion of the relevant conductor by means of a laser.

The stripline resonators 3 and 4, the further conductor 11 and the base plates 1 and 2 are embedded in a dielectric material having a relatively high dielectric constant, such as barium-neodymium-titanate type of dielectric material. Such materials have a dielectric constant of approximately 70. The high dielectric constant of the dielectric enables filters of limited dimensions to be used. For example, such a filter made of the above-mentioned ceramic material on the basis of barium-neodymium-titanate has dimensions of 3.2 mm×1.6 mm×1.5 mm for an 1890 MHz center frequency.

Figure 2:
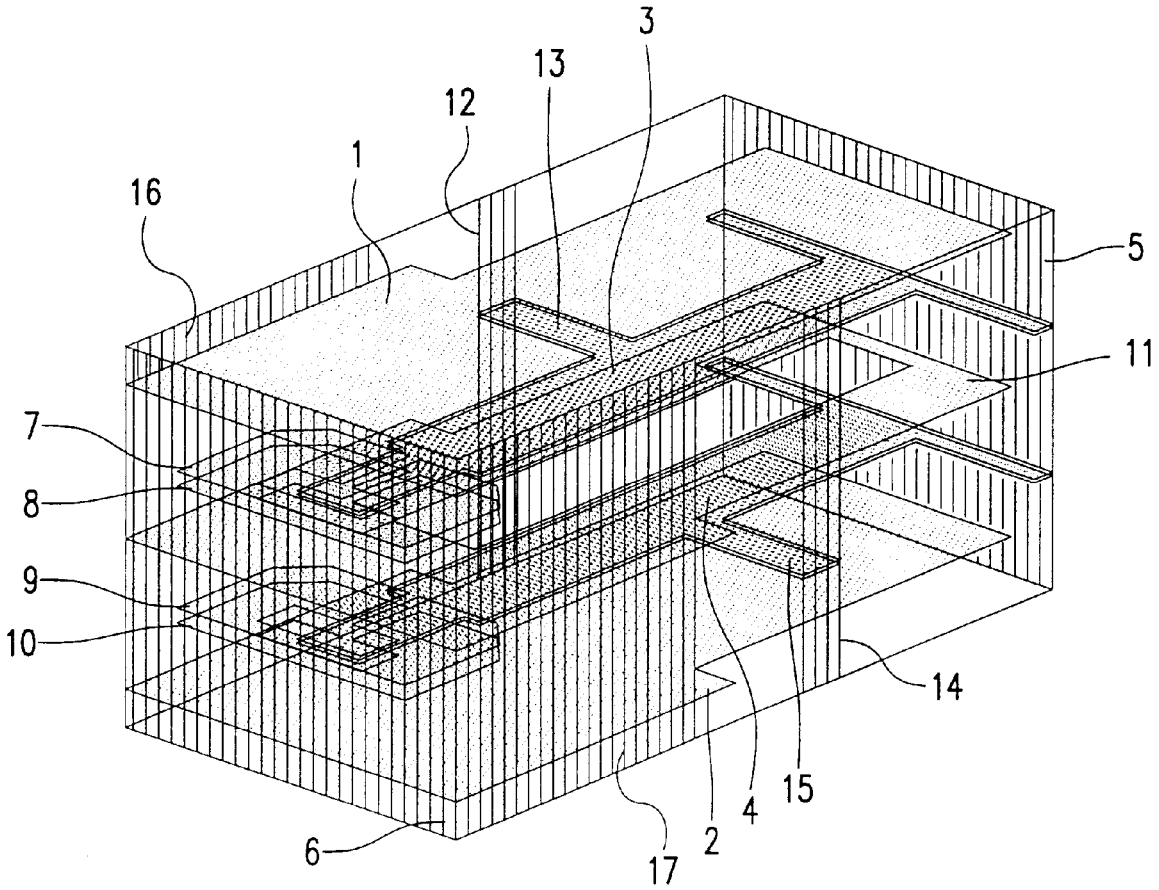
FIG. 2 is a schematic, perspective view of a ceramic filter with z-coupling.
Figure 3:
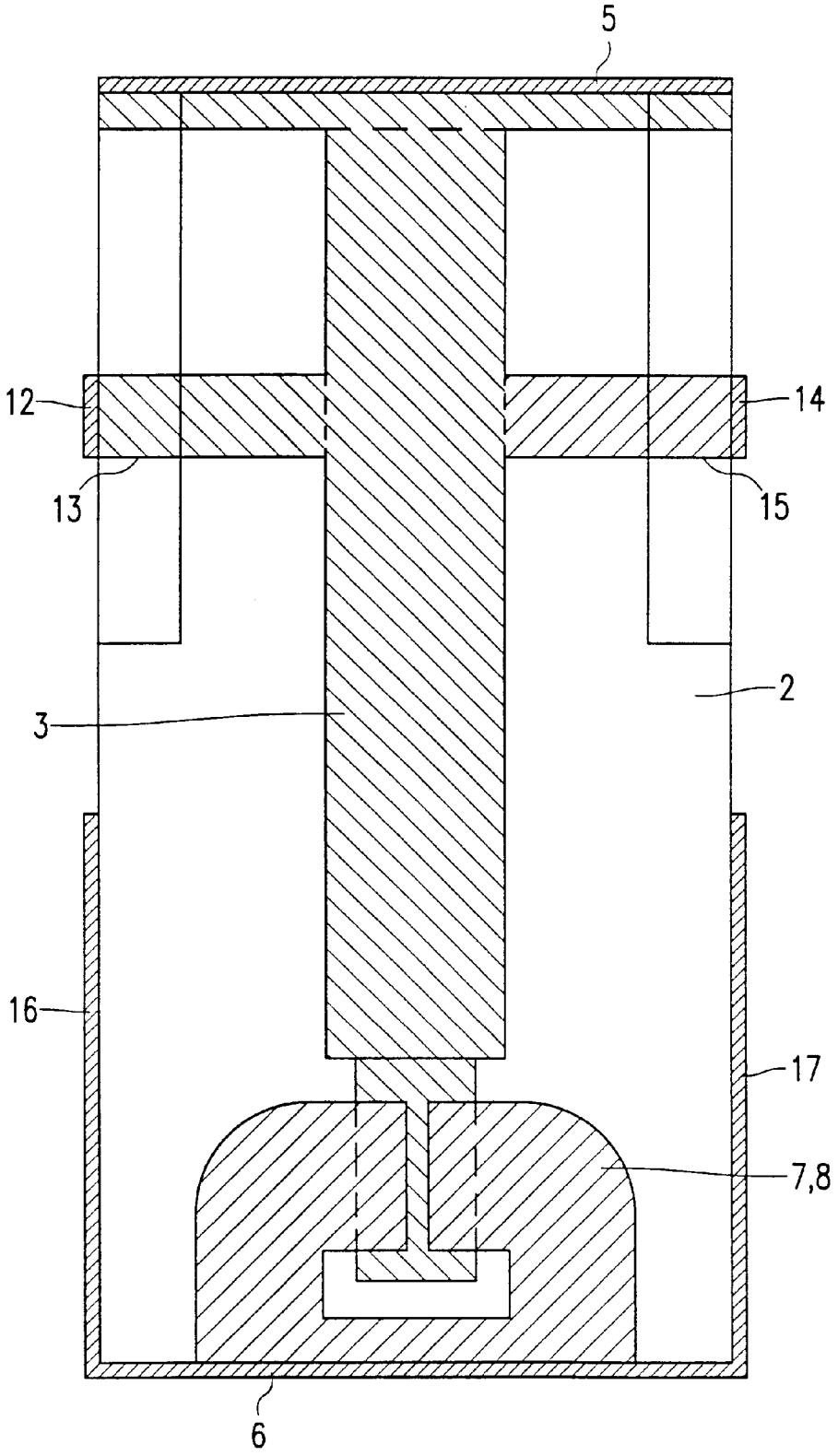
FIG. 3 is a cross-sectional view, in the longitudinal direction, of the filter in accordance with FIG. 2.

FIG. 3 shows a longitudinal sectional view of the filter in accordance with FIG. 2. FIG. 3 clearly shows the connection between the conductive side face 5 and an end of the stripline resonator 3. The other end of the stripline resonator 3 is capacitively coupled to the side face 6 by means of capacitor plates 7 and 8. Alignment errors made during providing the capacitor plates 7 and 8 do not affect the capacitance value of the capacitor because small displacements of said capacitor plates and the stripline resonator 3 relative to each other do not affect the overlapping surface.

A part of the base plate 2 is removed to preclude short-circuits between the contacts 12 and 14 and the base plate 2. The conductors 16 and 17, which may be shortened to adjust the filter, are situated on the outer surface of said filter. By virtue thereof, they are easily accessible to a laser by means of which a trimming operation is carried out, if necessary.

Figure 4:
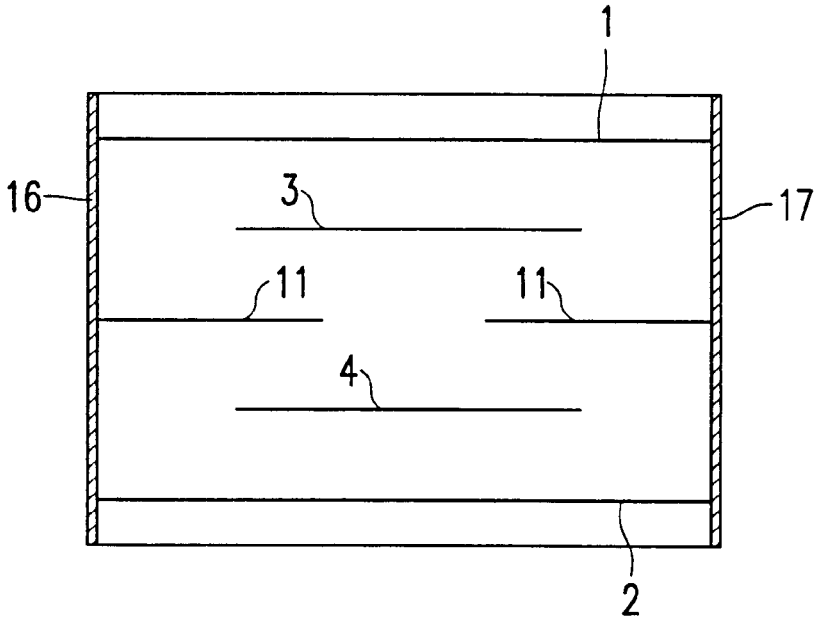
FIG. 4 is a sectional view, in a transverse direction, of the filter in accordance with FIG. 2.
Figure 5:
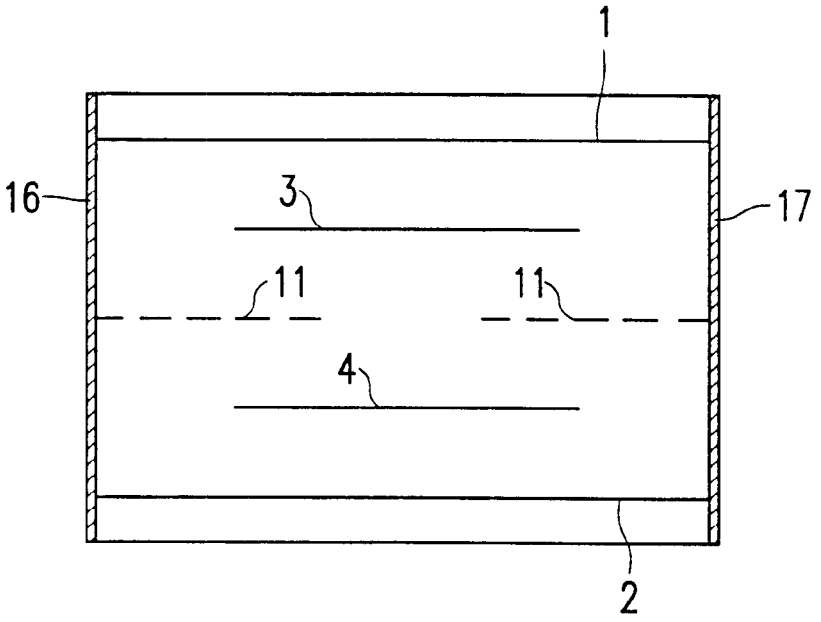
FIG. 5 is a sectional view, in a transverse direction, of an alternative embodiment of the filter in accordance with FIG. 2.

FIG. 4 is a sectional view, in a transverse direction, of the ceramic filter in accordance with FIG. 2. During operation of the filter, the stripline resonators 3 and 4 are electromagnetically coupled via a coupling opening in the further conductor 11. In addition, both stripline resonators 3 and 4 are surrounded by the two base plates 1 and 2. In an alternative embodiment in accordance with FIG. 4, the strip line resonators 3 and 4 are shifted sideways. This sideways shift of the stripline resonators 3 and 4 reduces the coupling between these stripline resonators, so that in some situations the further conductor 11 may become redundant. Another consequence of the sideways shift of the stripline resonators 3 and 4 is that the influence of the conductors 16 and 17 increases as a result of the smaller distance between the relevant conductor and one of the stripline resonators. This leads to an enlarged tuning range.

Filters of the above-mentioned types can be manufactured by means of thick-film techniques and multilayer techniques. This will be described in greater detail hereinbelow.

Exemplary Embodiments

Green ceramic foils on the basis of barium-neodymium-titanate having a thickness of approximately 50 micrometers were used as the starting material. Using a paste, a palladium metal layer was printed in accordance with a desired structure on these foils. In this manner, foils were obtained on which the structure of a stripline resonator, capacitor plates, a base plate or a further conductor with a coupling opening were printed as separate metal layers. The metal foils thus formed were stacked together with a number of unprinted foils to form a filter structure which largely corresponds to the one shown in FIG. 2. This structure comprises seven printed foils which are separated from each other by a number of unprinted foils of the same ceramic material.

The structure thus obtained was subsequently calcined at a temperature of approximately 350° C. so that the various binders and solvents were removed from the foils. Subsequently, the structure was subjected to pressure and simultaneously sintered at approximately 1300° C. Sintering preferably takes place under the influence of a uniaxial pressure which is exerted at right angles to the plane of the foils. This technique is described in greater detail in U.S. Pat. No. 4,612,689 assigned to the present assignee. The exertion of a uniaxial pressure during the sintering operation has the advantage that the dimensions of the printed metal layers in the x,y-direction (transverse to the direction in which the pressure is exerted) remain the same or change only very little.

Finally, the sintered filters were provided, at the side faces, with the necessary conductors by means of printing techniques. A cross-section was made of a umber of the filters thus obtained for the purpose of examining said filters. The thickness and the shape of the stripline resonators was visually inspected by means of a measuring microscope.

In a first experiment, a series of filters was manufactured in accordance with the above-mentioned method (A series). In this experiment, use was made of a palladium paste having a solids content of approximately 75% to print the stripline resonators and the other metal layers. The thickness of the applied palladium layers was approximately 10 micrometers. After sintering, it was found that the thickness of these layers was approximately 5 micrometers. The relatively thin metal layers terminated in a point. Measurements to which the finished filters were subjected revealed that the losses were relatively high (see Table).

In a second experiment, a series of filters was manufactured in accordance with the above-mentioned method (B series). In this experiment, use was made of the same paste. In this case, the metal layers provided had a thickness of 40 micrometers. After the sintering operation, the thickness measured in the middle of the stripline resonators was found to be approximately 21 micrometers. The relatively thick metal layers terminated in a point. Measurements to which the finished filters were subjected revealed that, although the losses were lower than in the filters of the A series, they were still relatively high (see Table).

In a third experiment, a series of filters was manufactured in accordance with the above-mentioned method (C series). In this experiment, the metal layers were made from a paste having a solids content of 80%. In this case, the metal layer provided had a thickness of approximately 44 micrometers. After the sintering operation, the layer thickness was 25 micrometers. The metal layers had the same average thickness over a large part of the surface. The layers terminated in a V-shaped point. Also in this case, the losses were still relatively high (see Table).

In a fourth experiment, a series of filters was manufactured in accordance with the above-mentioned method (D series). In this experiment, a paste having a solids content of 85% was used. To stack the foils, each individual printed foil was provided with a thin layer of a ceramic paste (solids content 85%). The ceramic material of the paste had the same composition as that of the foil. In this case, the applied metal layer had a thickness of approximately 48 micrometers. After the sintering operation, the layer thickness was 26 micrometers. The metal layers had a predominantly rectangular end. The thickness, measured at both ends, was more than 80% of the average thickness of the layer. In this case, the losses exhibited an acceptable value (see Table).

In the Table, the data of the above-mentioned experiments are listed. Said Table shows that an acceptable value of 2.3 dB is achieved if use is made of filters with stripline resonators whose shape, viewed in section, is rectangular and whose thickness is at least 10 micrometers.

TABLE

| Series | insertion losses | rectangularity | thickness |
|---|---|---|---|
| A | 5.1 dB | −− | 5 micrometer |
| B | 3.2 dB | − | 21 micrometer |
| C | 2.8 dB | − | 25 micrometer |
| D | 2.3 dB | + | 26 micrometer |

Figure 6:
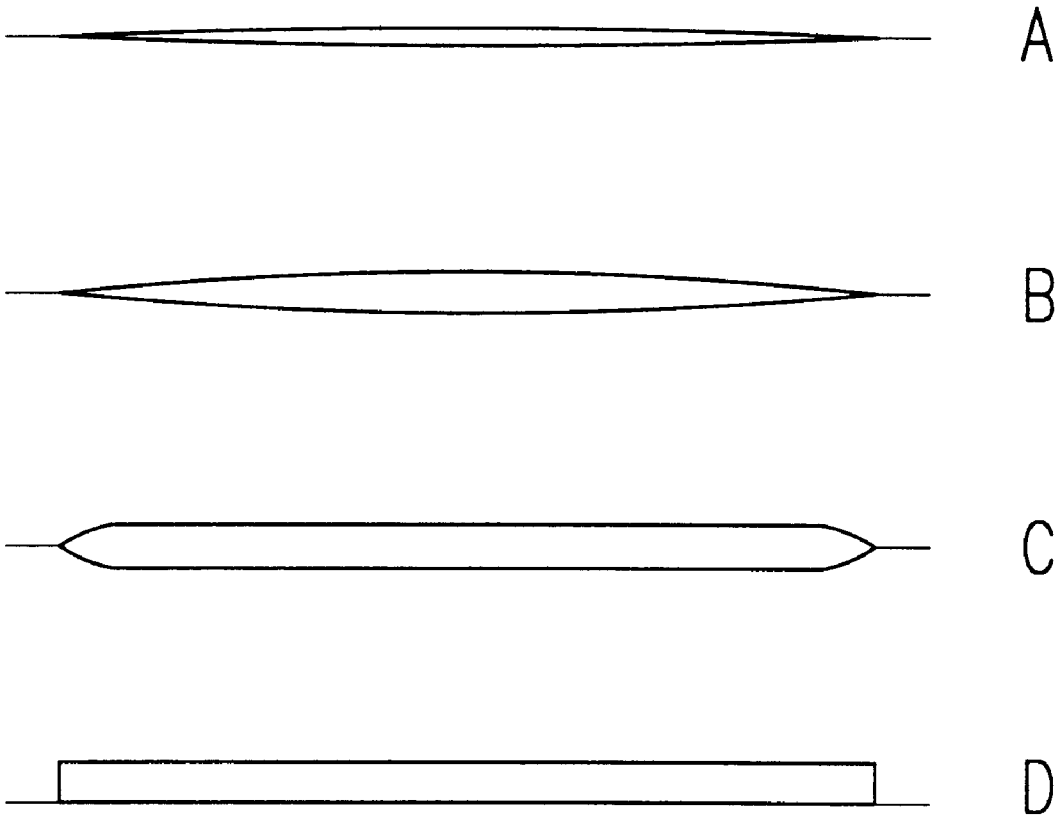
FIG. 6 is a sectional view, in a transverse direction, of the stripline resonators of a number of filters manufactured in accordance with the invention.

FIG. 6 shows, in cross-section, the shape of the stripline resonators as observed in sawn-through filters manufactured in the above-mentioned embodiments. The letter behind each one of the cross-sections corresponds to the above-mentioned series. This Figure shows that, when specific measures are taken, ceramic filters can be manufactured having relatively thick stripline resonators whose shape, viewed in cross-section, is predominantly rectangular. This can be achieved, inter alia, by using a combination of a palladium paste having a solids content of at least 80% and a layer of a ceramic material. It has been found that such, predominantly rectangular, resonators of sufficient thickness bring about a substantial reduction of the insertion losses in filters.

We claim:

1. A ceramic filter comprising at least two stripline resonators extending between side faces thereof and which are separated by a ceramic dielectric, said resonators becoming electromagnetically coupled during filter operation; each resonator being a metal layer formed at least in part by printing a metallic paste in a predetermined pattern onto one or more foils of said ceramic dielectric and stacking said foils together; each of said metal layers being at least 10 micrometers thick and having a cross-section between said side faces which is substantially entirely rectangular.

2. A ceramic filter as claimed in claim 1, characterized in that the metal layers extend in at least two, substantially parallel, non-coinciding planes, and as viewed in a direction normal thereto said layers at least partly overlap.

3. A ceramic filter as claimed in claim 1, characterized in that the metal layers predominantly comprise palladium.

* * * * *